US006375481B2

(12) United States Patent
Zweigle

(10) Patent No.: US 6,375,481 B2
(45) Date of Patent: Apr. 23, 2002

(54) ELECTRICAL PLUG AND SOCKET CONNECTOR HAVING AN ACTUATING LEVER

(75) Inventor: Peter Zweigle, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/732,860

(22) Filed: Dec. 8, 2000

(30) Foreign Application Priority Data

Dec. 8, 1999 (DE) ..... 299 21 536 U

(51) Int. Cl.[7] ..... H01R 13/62
(52) U.S. Cl. ..... 439/157; 439/372
(58) Field of Search ..... 439/157, 158, 439/159, 160, 372, 559, 261

(56) References Cited

U.S. PATENT DOCUMENTS 5,110,301 A * 5/1992 Inoue et al. ..... 439/157
5,496,186 A * 3/1996 Dobbelaere et al. ..... 439/157
5,722,843 A * 3/1998 Kerckhof et al. ..... 439/372
5,873,745 A * 2/1999 Duclos et al. ..... 439/157
5,928,012 A * 7/1999 Kitamura ..... 439/157

FOREIGN PATENT DOCUMENTS

EP 0 273 999 7/1988

* cited by examiner

*Primary Examiner*—Renee Luebke
*Assistant Examiner*—Briggitte R. Hammond
(74) *Attorney, Agent, or Firm*—Kenyon & Kenyon

(57) ABSTRACT

An electrical plug and socket connector, having a socket part and a plug part, is described, the socket part including a housing, in which an actuating lever is mounted so that it can pivot about a pivot point. The lever includes teeth at its free end, which work together with an additional gearing element, which is connected to a plug connector that is displaceable in the housing almost parallel to the direction of insertion via guide grooves. The teeth of the actuating lever are arranged on an elliptical path with respect to the pivot point of the actuating lever, and the gearing element is arranged obliquely to the actual direction of displacement of plug connector.

3 Claims, 2 Drawing Sheets

ELECTRICAL PLUG AND SOCKET CONNECTOR HAVING AN ACTUATING LEVER

FIELD OF THE INVENTION

The present invention relates to an electrical plug and socket connector having a socket part and a plug part, the plug part including a housing, in which an actuating lever is mounted so that it can pivot about a pivot point and it includes teeth at its free end which work together with an additional gearing, the gearing being connected to a plug connector that is displaceable in the housing almost perpendicularly to the direction of insertion via guide tracks.

BACKGROUND INFORMATION

The socket part is generally a part attached to a printed circuit board and has a plurality of plug contacts, for example, arranged in a plurality of rows.

Such connector arrangements are used, for example, in motor vehicles, when commercially available plug and socket connectors provide no possibility of contact. For reasons of space, the entire plug and socket connector should be only slightly larger than the actual socket part, with the result that the plug part that will be connected to the socket part cannot be easily gripped for disconnecting the plug and socket connection. Furthermore, the fact that a considerable force is used in order to disconnect the plug and socket connection due to the plurality of contact elements made for a plug and socket connection represents a problem.

In addition, there is the danger, when configuring plug and socket connectors which may only take up a very small place but have a plurality of contact elements, that contact elements may become damaged when connecting or disconnecting is performed inaccurately.

European Patent No. 273 999 describes an electrical plug and socket connector having a socket part and a plug part, the plug part including an actuating lever which is pivotably mounted in the connector part via a stationary rotation shaft. On its end opposite the actuating elements, the actuating lever has teeth that engage with a rack. This rack is firmly connected to a plug connector displaceably mounted in the plug part. In order to establish the connection, the plug part is placed on the socket part and the actuating lever is pivoted. The plug connector is displaced perpendicularly to the direction of insertion by the pivoting motion of the actuating lever, the cam projections arranged on the socket part engaging with the guide grooves arranged in the plug part, so that the plug part together with the plug connector is drawn in the direction of the socket part, so that electrical contact and thus the electrical plug and socket connection is established.

One important disadvantage of the above-described plug and socket connector is that, as the actuating lever is actuated to establish the electrical connection between the socket part and the plug part, the actuating force increases, first because a plurality of electrical contacts is established via the plug contacts, and second because other counterforces, for example, caused by sealing lips, are to be overcome at the same time. This results in operation that is not very convenient, because such plug and socket connectors are operated in small places.

SUMMARY OF THE INVENTION

An object of the present intention is to eliminate the disadvantages of the related art.

In principle, this object is achieved by striving to keep the actuating force applied to the actuating lever constant as far as possible during the entire pivoting movement, i.e., from the open position to the closed position.

This object is achieved by the fact that the teeth of the actuating lever are arranged on an elliptical path with respect to the pivot point of the actuating lever, the gearing being arranged obliquely to the actual direction of displacement of the plug connector.

One important advantage of the present invention is that the actuating force required for connecting the plug part to the socket part is approximately constant during the entire pivoting motion of the actuating lever because, due to the arrangement of the teeth on the actuating lever, the reduction ratio between the teeth on the actuating lever and the gearing changes during the pivoting motion. This change causes the force necessary to achieve coupling of the plug part with the socket part to have the same absolute value, in particular, immediately prior to the end of the closing motion as at the beginning of the closing motion, the path of the lever becoming smaller toward the end of the closing motion due to the changing reduction ratio.

The plug connector displaceably mounted in the housing is guided by cam projections arranged on the lateral parts of the socket part, which slide in the guide grooves during the motion of the plug part.

These guide grooves are preferably designed so that, in order to correctly place the plug part onto the socket part, the cam projections penetrate the openings in the guide grooves, these openings pointing to the opening of the plug part.

The actuating lever pivotably mounted in the plug part is preferably designed so that its U-shaped legs enclose the plug part on both sides, whereby a very stable actuating lever design is achieved, which remains operable even in difficult to access areas.

DETAILED DESCRIPTION

Figure 1:
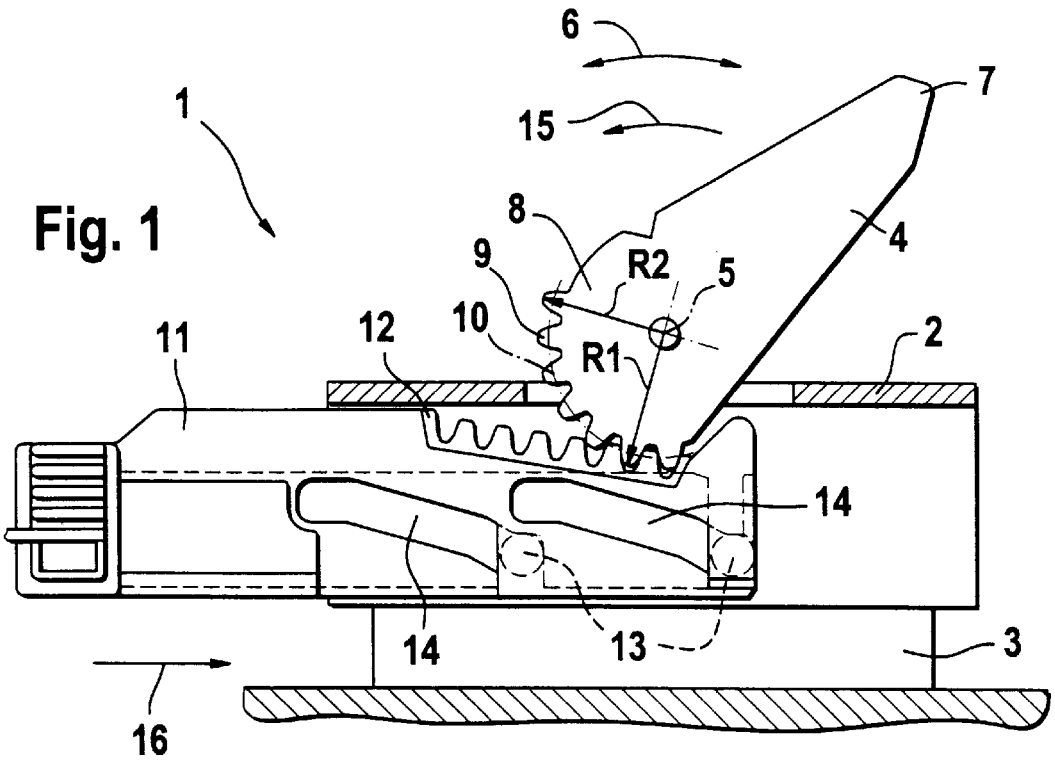
FIG. 1 schematically shows the electrical plug and socket connector according to the present invention in a first position.
Figure 2:
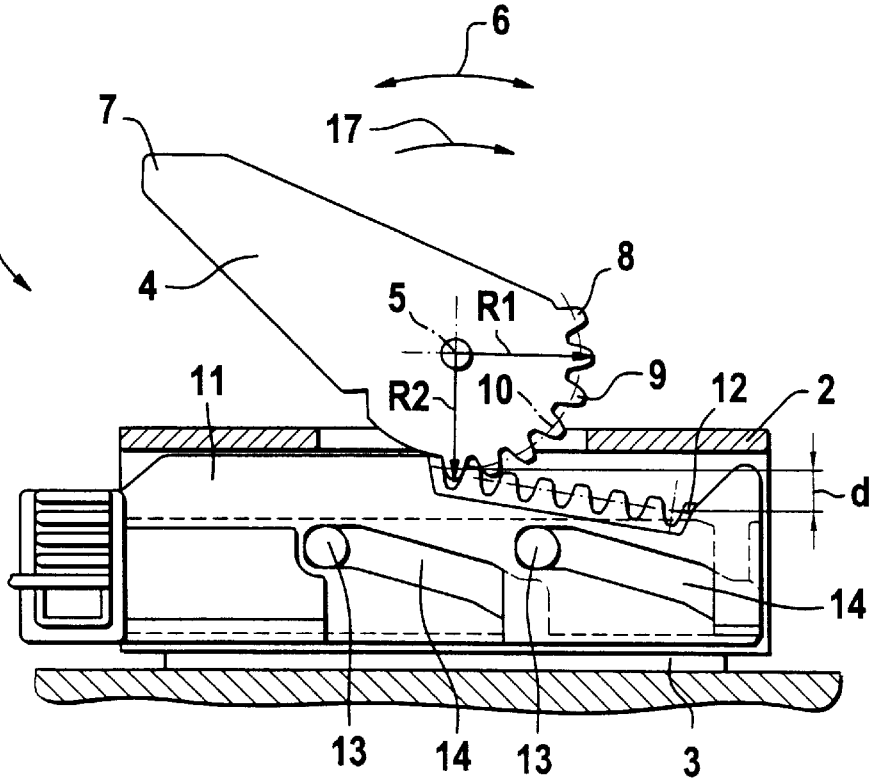
FIG. 2 schematically shows the electrical plug and socket connector according to the present invention in a second position.
Figure 3:
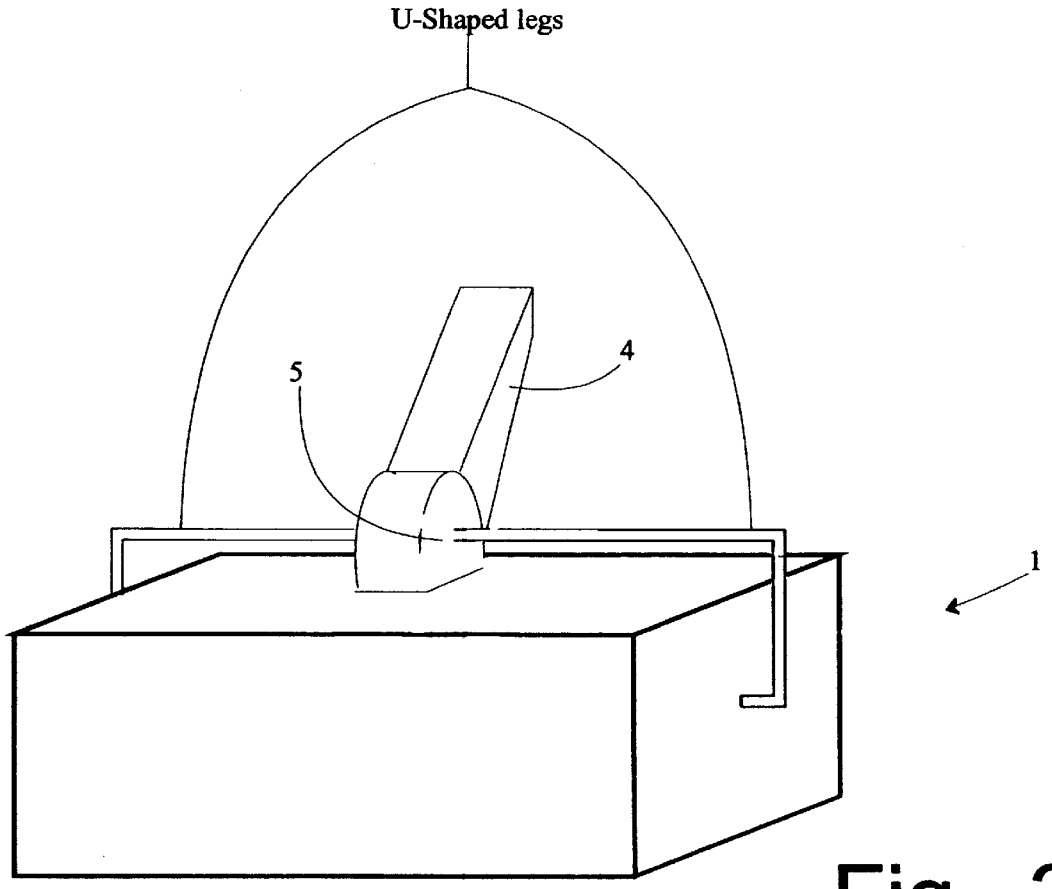
FIG. 3 shows an actuating lever mounted on a plug part about a pivot point, wherein the legs of the lever enclose the plug part on both sides of the plug part and allow the lever to pivot, in accordance with the present invention.
Figure 4:
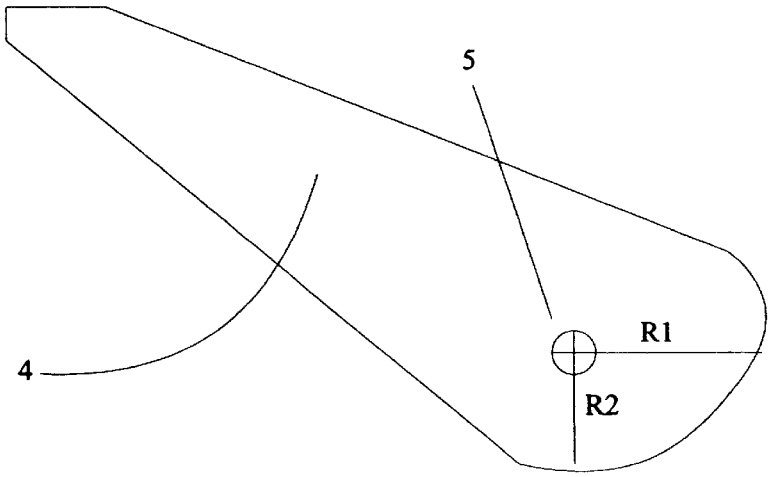
FIG. 4 schematically shows the actuating lever being U-shaped and pivotable about pivot point, in accordance with the present invention.

Plug and socket connector 1 shown in FIGS. 1 and 2 has a plug part 2 and a socket part 3. Plug part 2 is designed so that an actuating lever 4 is mounted on plug part 2 at its pivot point 5 so that it can pivot in the direction of a double arrow 6. This actuating lever 4 has an actuating area 7 and a function area 8. Function area 8, which is located opposite actuating area 7, has teeth 9 at its end, which are arranged on an elliptical path 10 with respect to pivot point 5.

A plug connector 11 is displaceably mounted in plug part 2, plug connector 11 having a gearing element 12 on its side pointing to actuating lever 4; gearing element 12 is engaged with teeth 9 of actuating lever 4.

In order to establish an electrical plug and socket connection, plug part 2 is placed on socket part 3, cam projections 13 laterally arranged on socket part 3 engaging with guide grooves 14 laterally arranged on the plug part.

When actuating lever 4 is moved in the direction of arrow 15 according to FIG. 1, after plug part 2 has been placed on socket part 3 and cam projections 13 have been introduced in guide grooves 14, plug connector 11 arranged in plug part 2 is displaced in the direction of arrow 16 (according to FIG. 1) until actuating lever 4 reaches its end position as shown in FIG. 2. During the pivoting motion in the direction of arrow 15, teeth 9 of actuating lever 4 engage with gearing element 12 and slide down on it. The reduction ratio between teeth 9 and gearing 12 changes due to the pivoting motion of actuating lever 4, because the circular segment radius is R1 in the situation shown in FIG. 1 and R2 in the situation shown in FIG. 2, R1 being greater than R2. In order for teeth 9 of actuating lever 4 to remain engaged during the entire pivoting motion in the direction of double arrow 6, gearing element 12 is arranged obliquely. The height difference of the oblique arrangement is d; the required radius R1 is then calculated from this using radius R2 by adding the absolute values of the two quantities d and R2.

In order to disconnect the connection, actuating lever 4 is moved in the direction of arrow 17 according to FIG. 2 and teeth 9 slide down on gearing element 12 until plug part 2 reaches the position according to FIG. 1, so that plug part 2 can be detached freely from socket part 3.

Due to the changing reduction ratio during the pivoting motion of actuating lever 4, it is possible for the actuating force necessary to bring actuating lever 4 from a first position to a second position and back again to be almost constant during the entire pivoting motion, so that simple operation is possible even in a very restricted space.

| Reference Symbols List | |
|---|---|
| 1 | plug and socket connector |
| 2 | plug part |
| 3 | socket part |
| 4 | actuating lever |
| 5 | pivot point |
| 6 | double arrow |

-continued

| Reference Symbols List | |
|---|---|
| 7 | actuating area |
| 8 | function area |
| 9 | teeth |
| 10 | elliptical path |
| 11 | plug connector |
| 12 | gearing element |
| 13 | cam projections |
| 14 | guide grooves |
| 15 | arrow direction |
| 16 | arrow direction |
| 17 | arrow direction |

What is claimed is:

1. An electrical plug and socket connector, comprising:

a plug connector;

a gearing element connected to the plug connector;

an actuating lever including teeth arranged at a free end thereof, the teeth cooperating with the gearing element;

a socket part including a housing in which the actuating lever is mounted so that the actuating lever can pivot about pivot point; and a plug part, wherein:

the plug connector is displaceable in the housing almost parallel to a direction of insertion via guide tracks, the teeth of the actuating lever are arranged on an elliptical path with respect to the pivot point of the actuating lever, and the gearing element is arranged obliquely to an actual direction of displacement of the plug connector.

2. The plug and socket connector according to claim 1, wherein:

the socket part includes cam projections that are enclosed by the guide tracks when the plug part is plugged in.

3. The plug and socket connector according to claim 1, wherein:

the actuating lever has a U-shaped design.

* * * * *